US005517391A

United States Patent [19]

Grau

[11] Patent Number: 5,517,391

[45] Date of Patent: May 14, 1996

[54] KIT FOR DESIGNING A LIGHTING ARRANGEMENT

[76] Inventor: Tobias Grau, Borselstrasse 18, 22765 Hamburg, Germany

[21] Appl. No.: 298,590

[22] Filed: Aug. 30, 1994

[30] Foreign Application Priority Data

Aug. 30, 1993 [DE] Germany ..... 9312965 U

[51] Int. Cl.[6] ..... F21S 1/02

[52] U.S. Cl. ..... 362/147; 362/404; 362/370; 439/110; 439/116

[58] Field of Search ..... 362/247, 249, 362/277, 250, 285, 418, 368, 269, 370, 371, 405, 404, 145, 287, 226, 431; 315/312, 324; 439/110, 112, 111, 116, 119, 118, 115; 248/222.3, 291, 68.1, 288.3, 343, 344, 342

[56] References Cited

U.S. PATENT DOCUMENTS

| | | | |
|---|---|---|---|
| 4,591,764 | 5/1986 | Nilssen | 362/404 X |
| 4,688,154 | 8/1987 | Nilssen | 362/404 |
| 4,747,025 | 5/1988 | Barton | 362/147 |
| 4,999,748 | 3/1991 | Aoshika | 362/147 |
| 5,025,355 | 6/1991 | Harwood | 362/147 |
| 5,128,842 | 7/1992 | Lin et al. | 362/147 |
| 5,249,107 | 9/1993 | Paulsen | 362/147 X |
| 5,341,276 | 8/1994 | Shen | 439/110 X |

FOREIGN PATENT DOCUMENTS

| | | | |
|---|---|---|---|
| 541428 | 5/1993 | France . | |
| 2685947 | 7/1993 | France . | |
| 0038592 | 3/1979 | Japan | 439/110 |
| 0116695 | 9/1979 | Japan | 439/110 |

*Primary Examiner*—Denise L. Gromada
*Assistant Examiner*—Thomas M. Sember
*Attorney, Agent, or Firm*—Sixbey, Friedman, Leedom & Ferguson; David S. Safran

[57] ABSTRACT

The invention relates to a kit for designing a lighting arrangement, in which light fixtures (8) are clamped in tracks with electric conductors, which are hung from the ceiling. The kit consists of the combination of two track elements (3) which are hung from a ceiling (9) by hanging rods (10) and a low-voltage transformer (12). The track elements (3) each have two recesses (4, 5) disposed one above the other at the same side of track element (3), and two low-voltage electric conductors (6) are arranged in one of the recesses (5) at a distance from and opposite one another, the other recess (4) being used to mount the light fixtures (8) and for connection of the track elements (3) on a track connector (7).

20 Claims, 8 Drawing Sheets

2
26
27
28
31
8

KIT FOR DESIGNING A LIGHTING ARRANGEMENT

BACKGROUND OF THE INVENTION

1. Field of the Invention

The invention relates to a kit for designing a lighting arrangement, in which the light fixtures are clamped in tracks with electric conductors, which are hung from the ceiling, i.e., so-called "track lighting" arrangements.

2. Description of Related Art

Track lighting arrangements are known in various embodiments for 220 V light fixtures. For low-voltage light fixtures, it is only known to arrange electrically conducting rods or wires running parallel to one another under the ceiling, between which low-voltage light fixtures or U-shaped lighting tracks can be hung, in which the lighting tracks are arranged so that they are closed in an upward direction.

SUMMARY OF THE INVENTION

The object of the invention is to provide a kit for designing a track lighting arrangement of the initially mentioned type, which can be equipped with low-voltage light fixtures.

According to the invention, the achievement of the object takes place by a combination of the following features:

a. a pair of elongated track elements, each of which has two adjacent elongated recesses in the same side of the track element, two low-voltage electric conductors being arranged in a first one of the recesses at a distance from one another and opposite one another, and a second of the recesses forming a holding means for light fixtures and track connectors;

b. at least two hanging rods for hanging the track elements from a ceiling, an end section of each rod having a track connector for positionally fixed connection in the second recess of the track elements; and c. at least one low-voltage transformer for supplying power to the electric conductors of the track elements and means for connecting the low voltage transformer with the low-voltage electric conductors in the first recess of the tracks.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figures 10, 11, 12, 13, 14, 15:
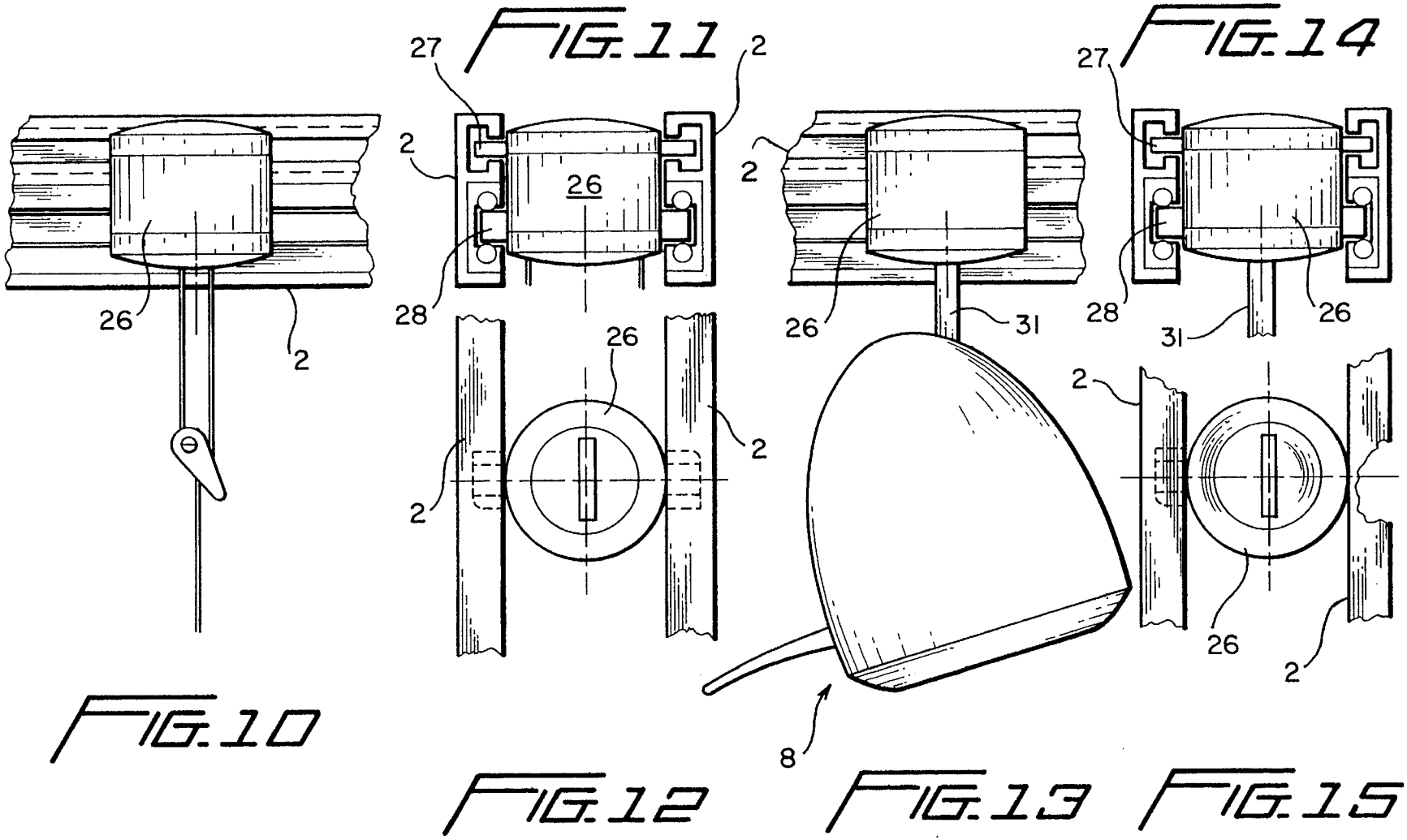
FIGS. 10–15 show an adapter for light fixtures in various views.

The kit for designing a lighting arrangement is comprised of a pair of tracks 1 formed from two tracks 2, at least two hanging rods 10, which can be connected with the pair of tracks 1, at least one low-voltage transformer 12, which can be brought into operative connection with the low-voltage electric conductors of tracks 2, and lights 8, which can be clamped by an adapter 26 to pair of tracks 1 (FIG. 13).

Figure 5:
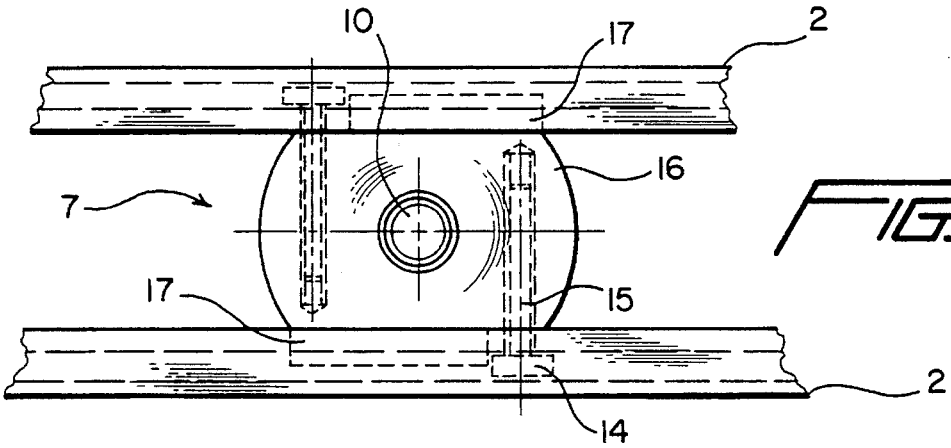
Figure 6:
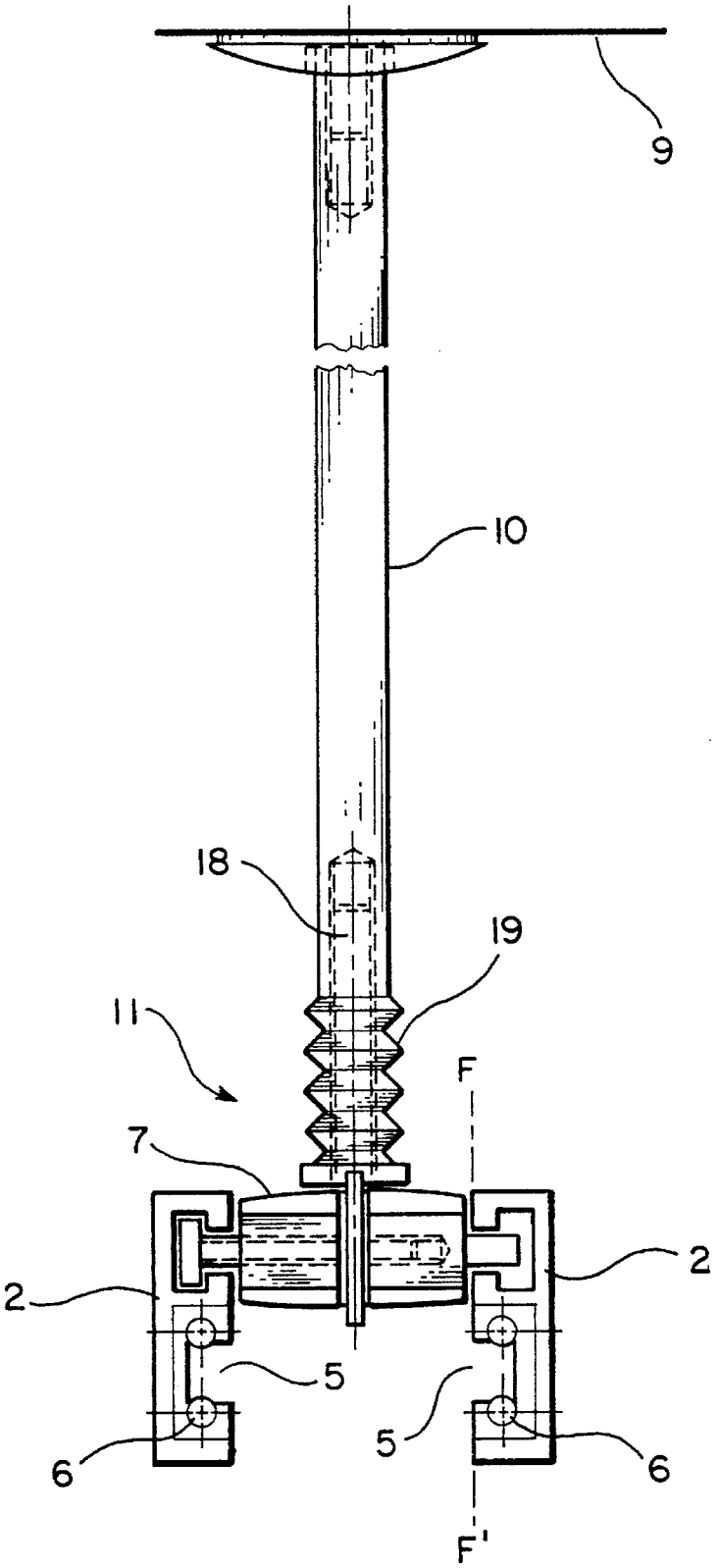

Track elements 3 of tracks 2 comprise two recesses 4, 5 next to one another and open toward the same side of track element 3. Two low-voltage electric conductors 6 are located in recess 5 at a distance from one another and opposite one another. Two contact studs 13 reducing the cross section of recesses 4 are arranged parallel to one another on recesses 4 of tracks 2. Contact studs 13 can be gripped from behind by heads 14 of screw bolts 15, which are arranged in spacers 16 of track connectors 7 (FIG. 5). Each spacer 16 of a track connector 7 is connected with a hanging rod 10, which can be fastened to a ceiling 9. To positionally fix tracks 2 on spacers 16, two arms 17, rectangular in cross section, are provided each spacer 16, opposite and parallel to one another. The arms 17 can be plugged into recesses 4 between the contact studs 13.

Figure 1:
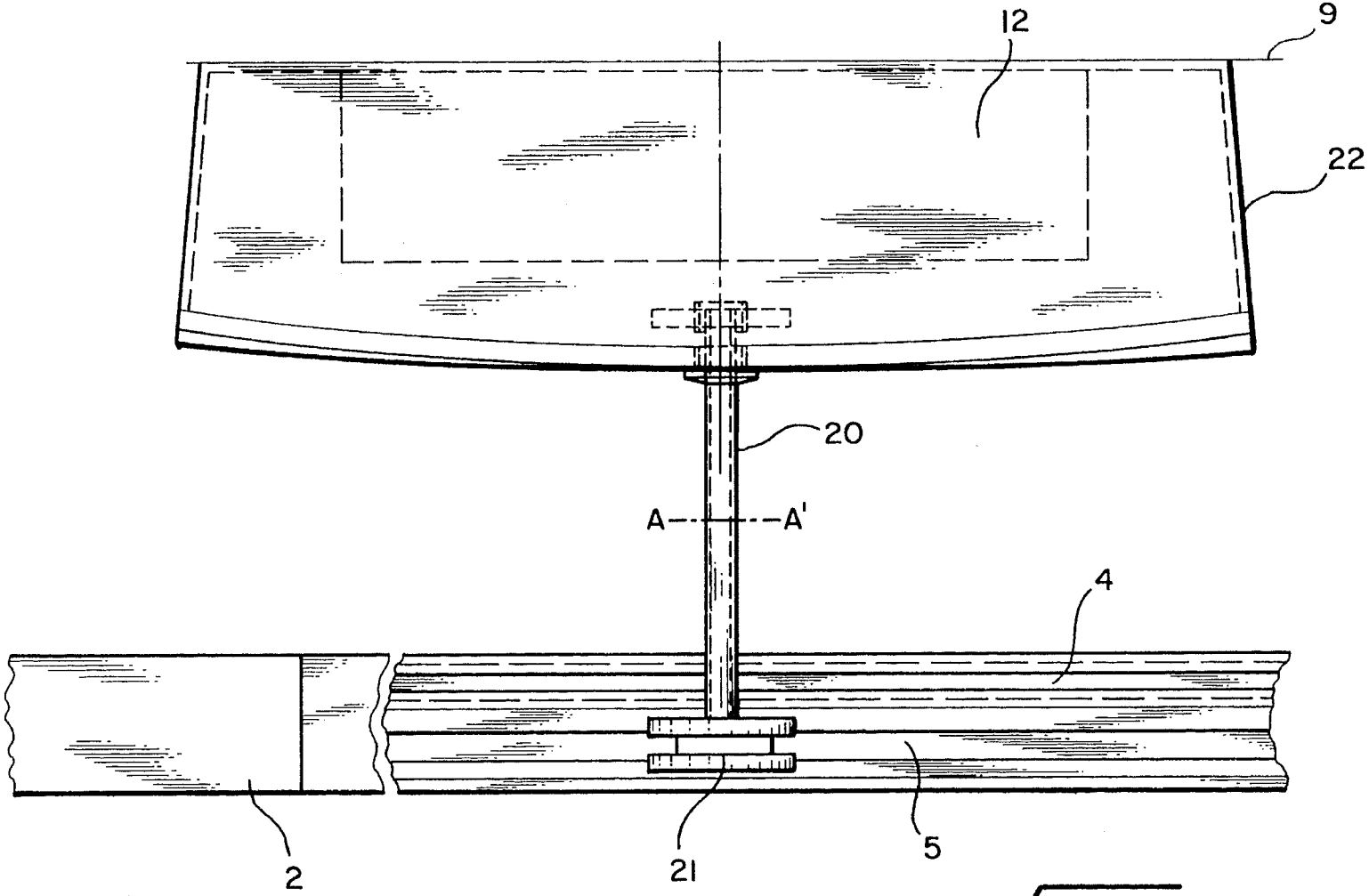
FIGS. 1 and 2 show the connection of the tracks of the lighting arrangement with a low-voltage transformer, which can be fastened to a ceiling, FIG. 1 being partially sectioned along line B—B' in FIG. 3.
Figure 2:
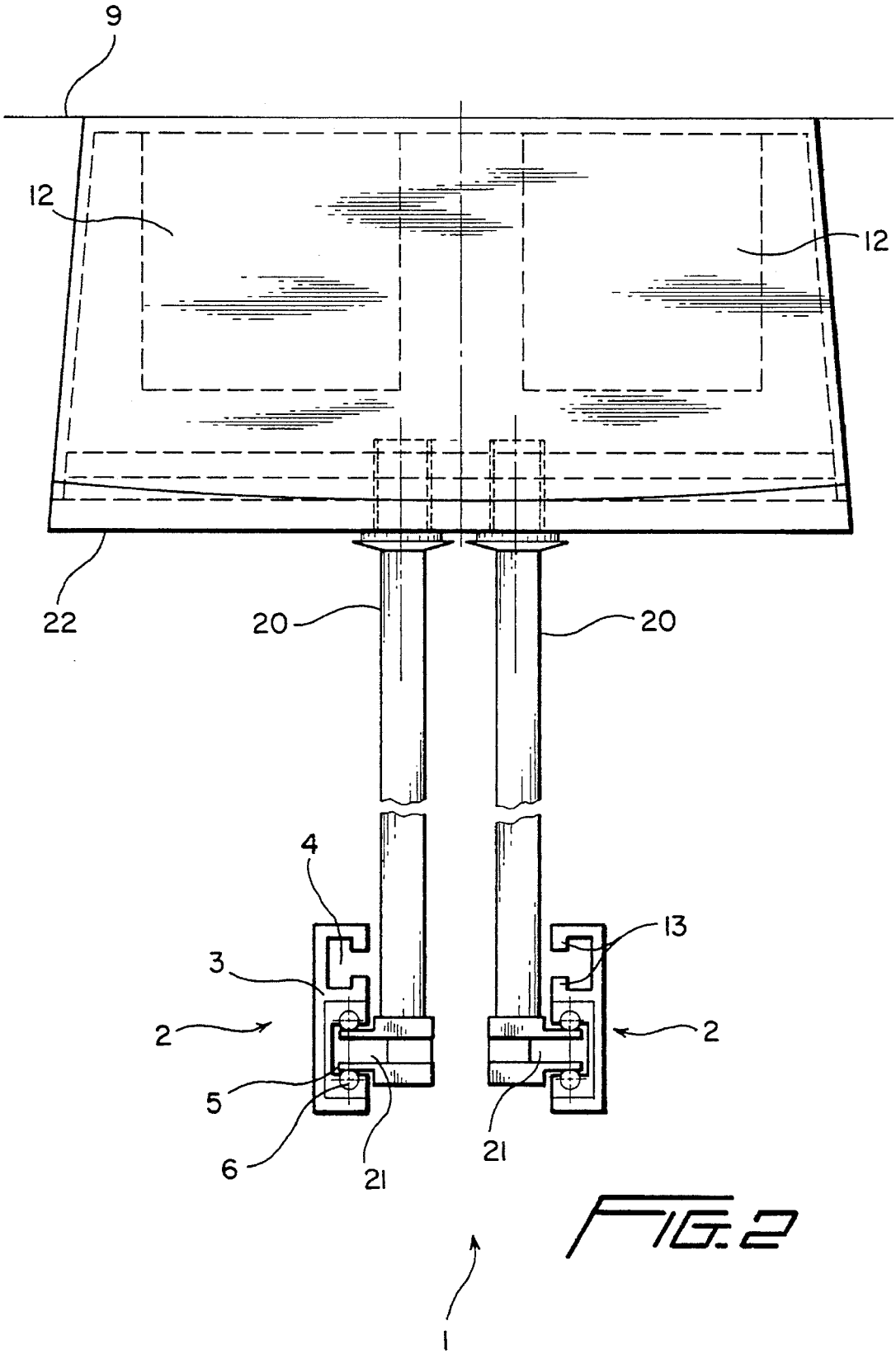
Figure 3:
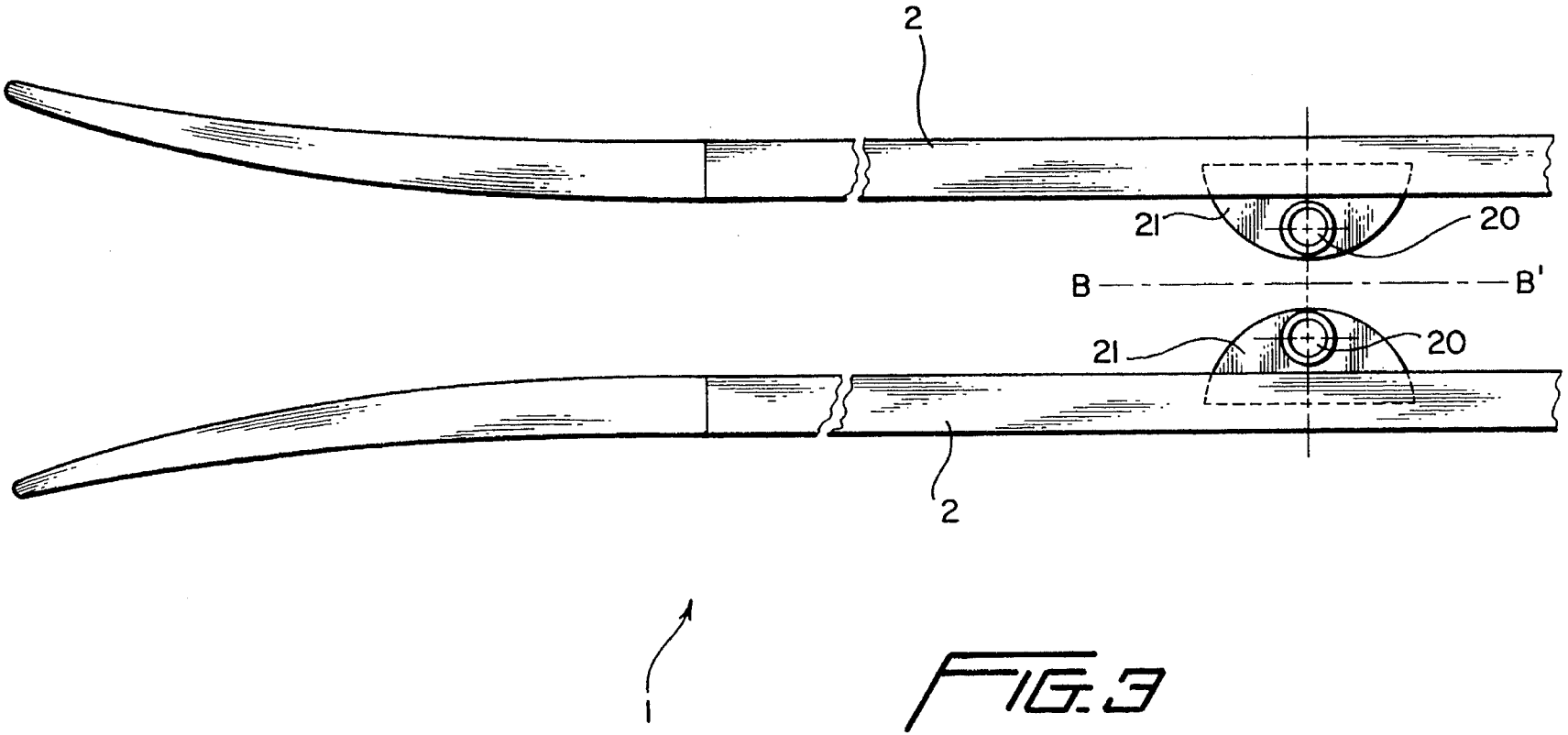
FIG. 3 shows a top view of the tracks according to FIGS. 1 and 2, connecting rods for the tracks being sectioned along lines A—A' in FIG. 1.
Figure 4:
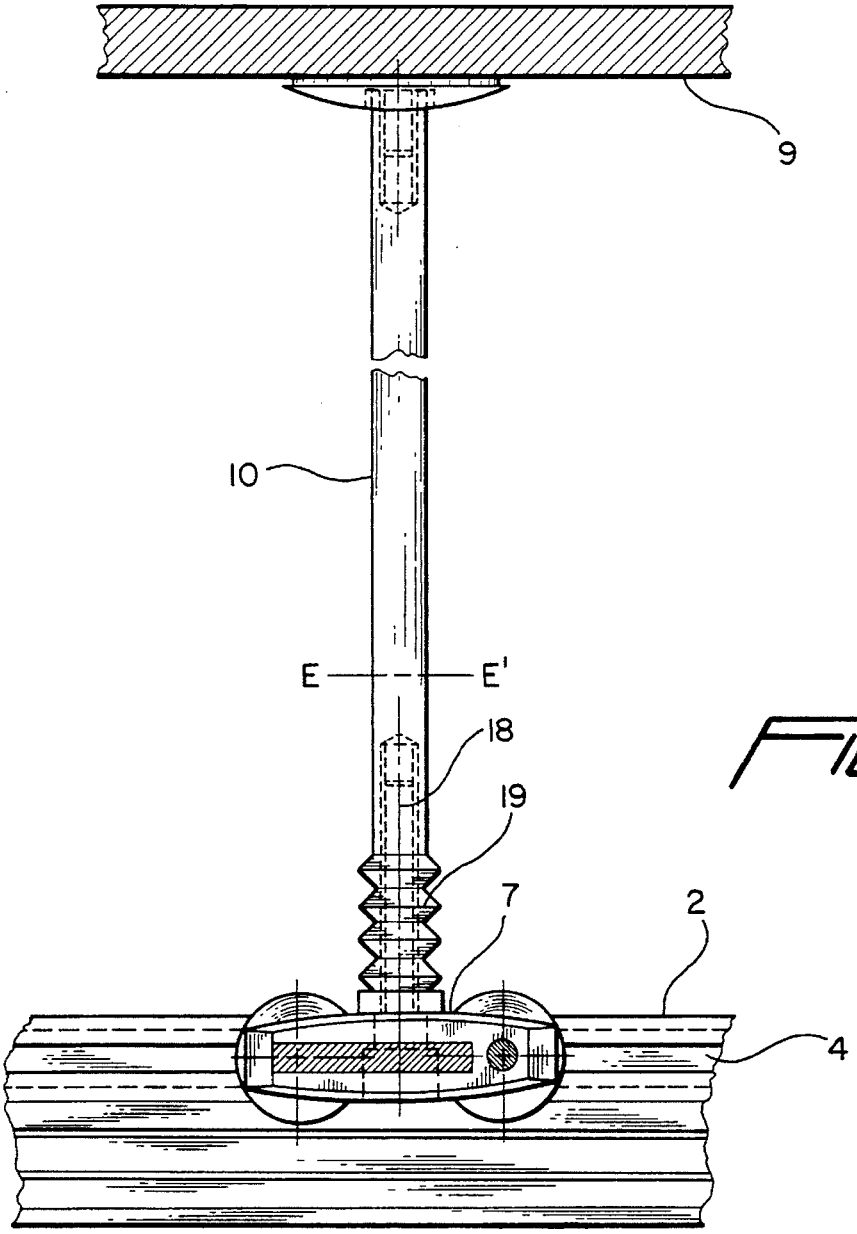
FIGS. 4–6 show a hanging rod with track connectors for the tracks according to FIG. 1 to 3, FIG. 4 being a view along line F—F', in FIGS. 5 and 6 being a view along line E—E' of FIG. 4.

For the power supply of low-voltage electric conductor 6, at least one low-voltage transformer 12 is used. In the design according to FIG. 2, two low-voltage transformers 12 are arranged in a housing 22, which is connected with ceiling 9. Each low-voltage transformer 12 is connected by a rod 20 with electric conductors 6 via a contact piece 21 extending from the rod 20 into recess 6 of track 2.

Spacers 16 of track connectors 7 are each connected in a height-adjustable manner with a hanging rod 10 by a screw 18. In this case, respectively, an elastic coupling 19 made of rubber or the like is arranged between spacers 16 and hanging rods 10. This coupling 19 conceals screw 18. Rods 20 of low-voltage transformers 12 are also arranged in a length-adjustable manner on housing 22 or the transformer housing, so that tracks 2 can be oriented precisely horizontally.

Figure 7:
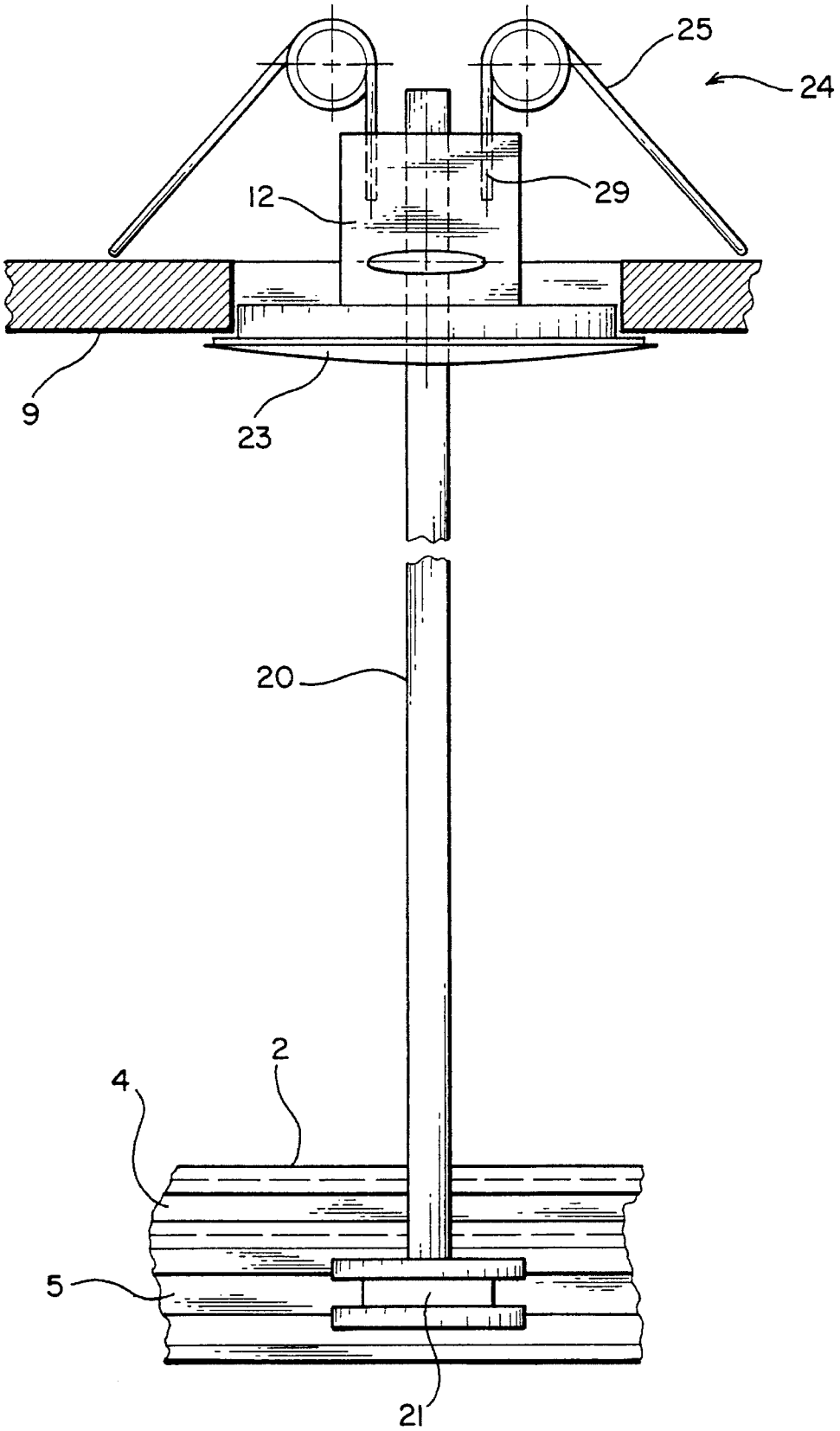
FIGS. 7–9 show a built-in ceiling low-voltage transformer with two hanging rods with contact pieces for the tracks in a side view along line D—D' of FIG. 9, an end view and a top view along line C—C' of FIG. 8, respectively.
Figure 8:
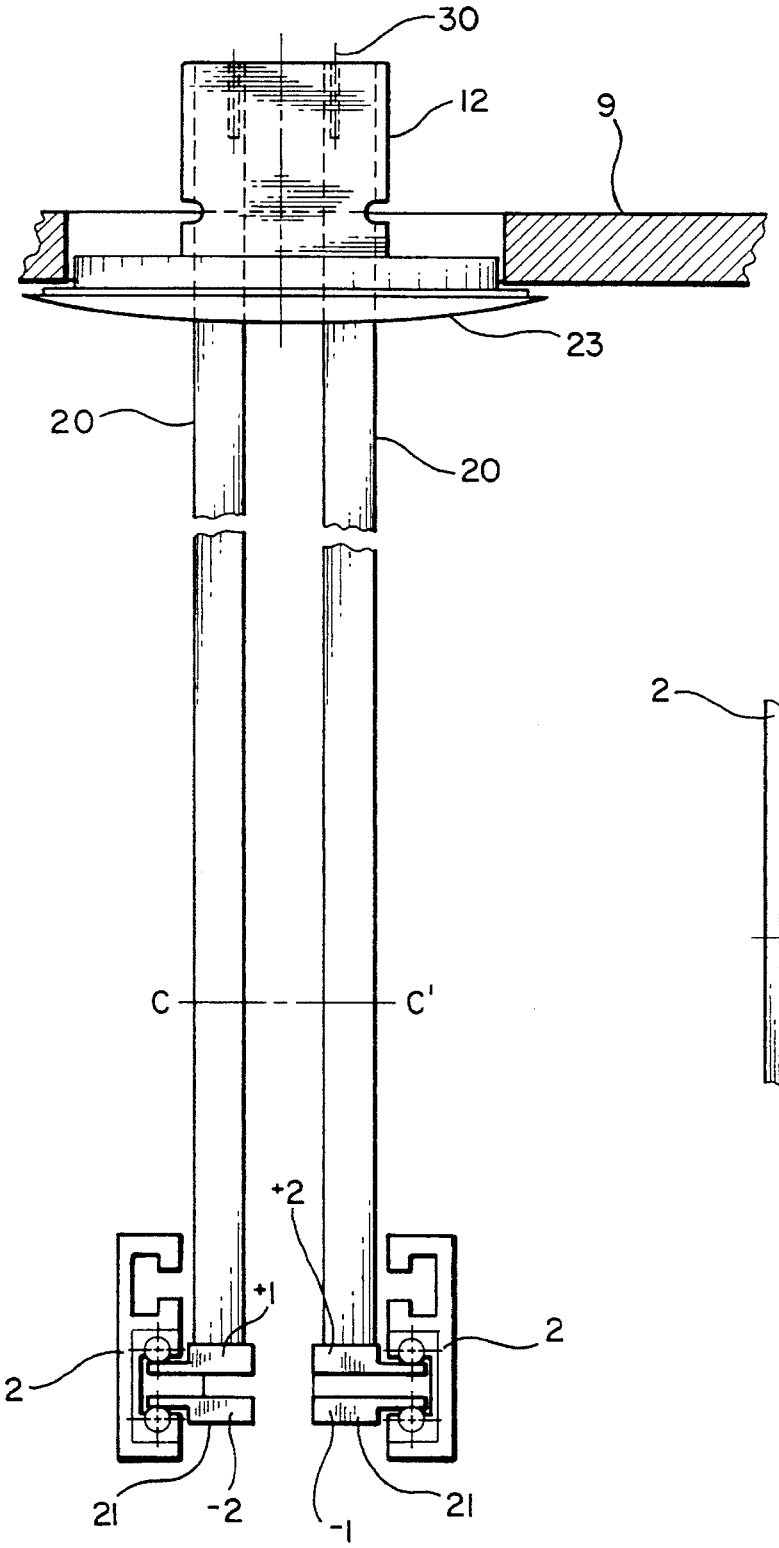
Figure 9:
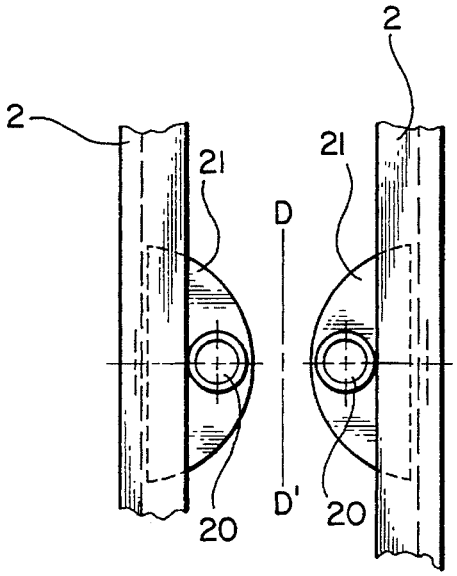

Low-voltage transformer 12 can also be arranged in a ceiling 9 and covered by a ceiling plate 23 (FIG. 7 and 8). In this case, holding devices 24 are then provided, which hold low-voltage transformer 12 in the desired position in ceiling 9. Holding devices 24 are designed as retaining springs 25 in the example represented in FIG. 7. The end sections 29 of the springs 25 facing the low-voltage transformer 12 can be inserted into recesses 30 made in the housing holding the low-voltage transformer 12.

To be able to connect light fixtures 8 with pair of tracks 1, an adapter 26 is provided in each case. The adapter 26 comprises two arms 27, 28, disposed one above the other at each opposite sides thereof. The upper arms 27 engage between contact studs 13 in recesses 4 of the respective track 2 and lower arms 28 serves as electric contact arms and can be brought to rest on low-voltage electric conductors 6. Light fixtures 8 can be connected with adapter 26 by, e.g. height-adjustable cables (FIGS. 10 to 12) or else can be connected with adapter 26 as a swivelable reflector head on a rotatable pipe 31 (FIG. 13 to 15). Pipe 31 is used to hold light fixtures 8 designed as a reflector head and to receive the electric cable, which runs from adapter 26 to the reflector head.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Track lighting kit for for producing a lighting arrangement in which light fixtures are clamped in tracks which are hung from a ceiling, comprising, in combination, the following:

a. a pair of elongated track elements, each of which has two adjacent elongated recesses in one side of the track element, two low-voltage electric conductors being arranged in a first one of the recesses at a distance from one another-and opposite one another, and a second of the recesses forming a holding means for the light fixtures and track connectors;

b. at least two hanging rods for hanging the track elements from the ceiling, an end section of each rod having a track connector for positionally fixed connection in the second recess of the track elements; and c. at least one low-voltage transformer for supplying power to the electric conductors of the track elements and means for connecting the low voltage transformer with the low-voltage electric conductors in the first recess of the tracks.

2. Kit according to claim 1, wherein the first recess has two contact studs which reduce the cross section of an open end thereof, the contact studs being arranged parallel to one another in the second recess; and wherein each track connector is provided with screw bolts arranged in a spacer, the screw bolts having heads for gripping the studs from behind.

3. Kit according to claim 2, wherein an arm that is rectangular in cross section is provided on each of opposite sides of the spacer, the arms being parallel to each other and being sized to plug into a respective second recess between the contact studs thereof.

4. Kit according to claim 3, wherein the spacer of the track connectors is connectable with the hanging rods by a screw in a height-adjustable manner.

5. Kit according to claim 4, wherein an elastic coupling is provided for covering the screw between the spacer and the hanging rod.

6. Kit according to claim 1, wherein a respective connector rod with a contact piece is provided for connecting each of the low-voltage electric conductors with the at least one voltage transformer.

7. Kit according to claim 6, wherein the connector rod is connectable in length-adjustable manner with the at least one low-voltage transformer.

8. Kit according to claim 7, wherein the at least one low-voltage transformer is arranged in a housing which is connectable with the ceiling.

9. Kit according to claim 7, wherein holding devices are provided for detachably fastening the at least one low-voltage transformer to the ceiling, and wherein at least one ceiling plate is provided for covering the at least one transformer from below.

10. Kit according to claim 9, wherein the holding devices are formed by retaining springs.

11. Kit according to claim 2, wherein an adapter is provided for connection of said pair of track elements with a respective light fixture, said adapter comprising an upper arm and a lower arm at each of opposite sides thereof; wherein the upper arms are engageable in the second recesses of the track elements between the contact studs; and wherein the lower arms form electric contacts for contacting on the low-voltage electric conductors in recesses of tracks elements.

12. Kit according to claim 11, wherein the adapter has a pipe for mounting of the light fixture thereto.

13. Kit according to claim 11, wherein the adapter has height adjustable cables for mounting of the light fixture thereto.

14. Kit according to claim 2, wherein each of the track connectors comprises a spacer that is connectable with the hanging rods by a screw in a height-adjustable manner.

15. Kit according to claim 14, wherein an elastic coupling is provided for covering the screw between the spacer and the hanging rod.

16. Kit according to claim 1, wherein said at least one low-voltage transformer comprises a plurality of low-voltage transformers and lighting fixtures, the low-voltage transformers corresponding in number to the number of lighting fixtures; and wherein a respective connector rod with a contact piece is provided for connecting each of the low-voltage electric conductors with a respective low-voltage transformer.

17. Kit according to claim 16, wherein the connector rod is connectable in a length-adjustable manner with the respective low-voltage transformer.

18. Kit according to claim 17, wherein each low-voltage transformer is arranged in a respective housing which is connectable with the ceiling.

19. Kit according to claim 17, wherein holding devices are provided for detachably fastening each low-voltage transformer to the ceiling, and wherein a ceiling plate is provided for covering each low-voltage transformer from below.

20. Kit according to claim 19, wherein the holding devices are formed by retaining springs.

* * * * *